US006010104A

United States Patent [19]

Hanson et al.

[11] Patent Number: 6,010,104

[45] Date of Patent: Jan. 4, 2000

[54] COMBINED CONTAINER HOLDER AND ENGAGED SEAT

[76] Inventors: David S. Hanson, 138 Indian Hill St., West Newbury, Mass. 01985; Daniel N. Catlett, 11 Fredrickson Rd., Norfolk, Mass. 02056; Robert J. Buffone, Jr., 15 Hayden Woods, Wrentham, Mass. 02093

[21] Appl. No.: 09/094,715

[22] Filed: Jun. 15, 1998

[51] Int. Cl.[7] ..... A47K 1/08

[52] U.S. Cl. ..... 248/311.2; 248/309.1; 248/312.1; 248/315

[58] Field of Search ..... 248/311.2, 312.1, 248/314, 315, 208

[56] References Cited

U.S. PATENT DOCUMENTS

| | | | |
|---|---|---|---|
| 282,892 | 8/1883 | Hitchcock | 248/208 |
| 2,301,180 | 11/1942 | Hynek | 248/208 |
| 4,657,213 | 4/1987 | Hartlage | 248/309.1 |
| 4,697,780 | 10/1987 | Wenkman et al. | 248/314 |
| 4,795,211 | 1/1989 | Stern et al. | 248/311.2 |
| 4,984,722 | 1/1991 | Moore | 248/311.2 |
| 5,058,787 | 10/1991 | Chou | 248/312.1 |
| 5,118,059 | 6/1992 | Mainer | 248/314 |
| 5,139,222 | 8/1992 | Koorey et al. | 248/315 |
| 5,199,678 | 4/1993 | Luebke | 248/311.2 |
| 5,279,452 | 1/1994 | Huynh | 248/311.2 |
| 5,320,406 | 6/1994 | North | 248/311.2 |
| 5,474,272 | 12/1995 | Thompson et al. | 248/311.2 |
| 5,533,782 | 7/1996 | Goldman | 248/311.2 |
| 5,697,587 | 12/1997 | Israel | 248/311.2 |
| 5,813,579 | 9/1998 | Hendrickson | 248/311.2 |
| 5,865,412 | 2/1999 | Mason | 248/311.2 |
| 5,906,348 | 5/1999 | Orenstein | 248/311.2 |

*Primary Examiner*—Derek J. Berger
*Assistant Examiner*—Debbie Short
*Attorney, Agent, or Firm*—Thomas Zack; Joseph H. McGlynn; Patent & Trademark Services

[57] ABSTRACT

An apparatus for mounting a portable detachable cup holder to the seat of a patron at a sporting event or other event such as a theater. In the first embodiment a loop end receives the cup to be held and has a rigid straight member with a depending U-shaped end clip. The end clip is shaped and sided to fit over the rear portion of the patron's seat and hold the rigid member and loop end thereto while the length of the rigid member is about the same as the width of the seat. In a second embodiment, the cup holding loop is mounted to an angled rigid member having its own second loop which second loop fits over an upright rim edge of the horizontal seat.

2 Claims, 3 Drawing Sheets

FIG. 1
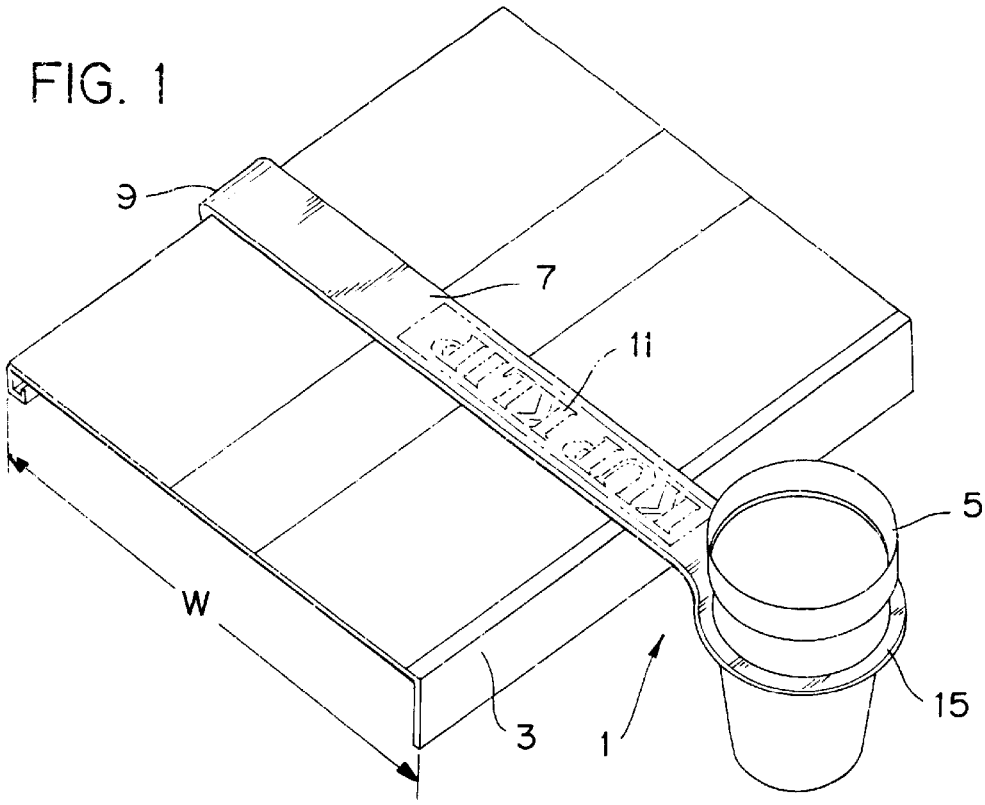
FIG. 2
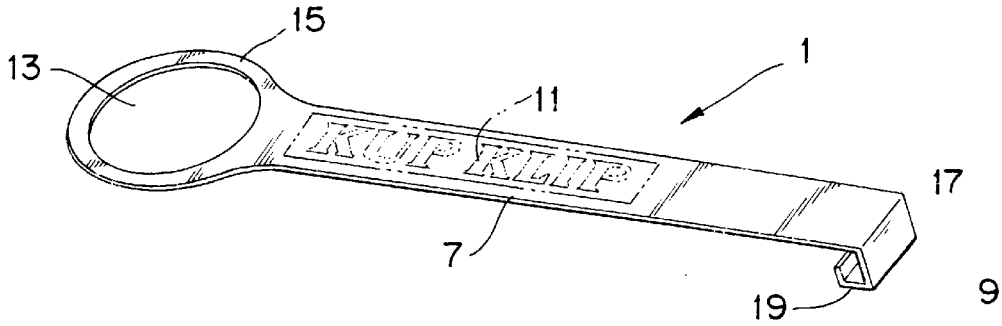
FIG. 3
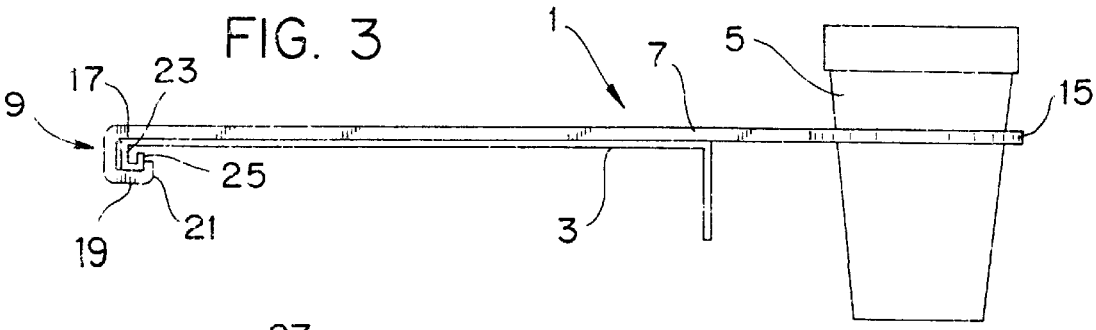
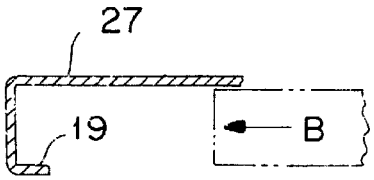
FIG. 4

COMBINED CONTAINER HOLDER AND ENGAGED SEAT

BACKGROUND OF THE INVENTION

Cup holders of various designs have been incorporated near seating arrangements. Good examples include built-in cup holders found next to: the arms of movie theater seats, automobiles seats and those found in sporting venue seats. In most respects these build-in integral cup holders have proven satisfactory for their intend purpose of allowing a patron to have their beverage cup held adjacent their seat by the holder in an upright elevated position while their hands are permitted to be free. These integral elevated cup holders also reduce the possibility compared to a cup placed upon the floor or ground near the seat that the cup will be accidentally spilled or have unwanted lower foreign objects being deposited in them. However, such built-in integral cup holders are present only in a small percentage of the existing seating in most sporting places or theaters. As a result in most places patrons still must place their beverage cup on the floor or ground if they desire their hands to be free or must hold the beverage cup with its liquid content during the observed event. The present invention seeks to overcome these disadvantages by providing for a portable easy seat fitted cup holder which can be brought to the sporting event or theater by a patron while permitting the user's hands to remain free as more fully described herein.

DESCRIPTION OF THE PRIOR ART

Built-in integral cup holders are well known. Such cup holders can be found adjacent seating in automobiles, theaters and various sporting events. Normally, the frame structure forming the holder for the hole used to receive the cup is either static with respect to the adjacent seat, such as in an integrally molded indentation next to the arm rest, or the cup holder may be movable within a confined guide structure such as a slid able cup holder structure found in many automobiles. The present invention relates to a cup holder which is portable and easily attached to and detachable from a seat such as is found in a sporting event or a theater all as more fully set forth in this specification.

SUMMARY OF THE INVENTION

This invention relates to portable attachable cup holder that can be mounted on the seating portion of an existing seat. The cup holder has a rounded cup holder section with a cup receiving hole attached to an elongated member which member extends to attach the holder to a portion of the existing seat structure.

It is the primary object of the present invention to provide for an improved portable cup holder that can be attached to an existing seating structure.

Another object is to provide for such a holder wherein there is an elongated extension member attached to the cup holder which spans the total width of the existing seat and is lock to the lower portion of the seat by a lower mounting extension member end clip.

These and other objects and advantages of the present invention will become apparent to readers from a consideration of the ensuing description and the accompanying drawings.

BRIEF DESCRIPTION OF THE DRAWINGS

FIG. 1 is a perspective view of the invention's preferred embodiment mounted on an existing stadium seat.

FIG. 2 is a perspective view of the FIG. 1 cup holder apparatus by itself.

FIG. 3(*a*) shows a side view of one embodiment for an adjustable elongated member.

FIG. 4 shows the end portion of an alternate mounting extension member end clip specifically designed for a flat wooden type bench seat.

DESCRIPTION OF THE PREFERRED EMBODIMENT

Figure 3A:
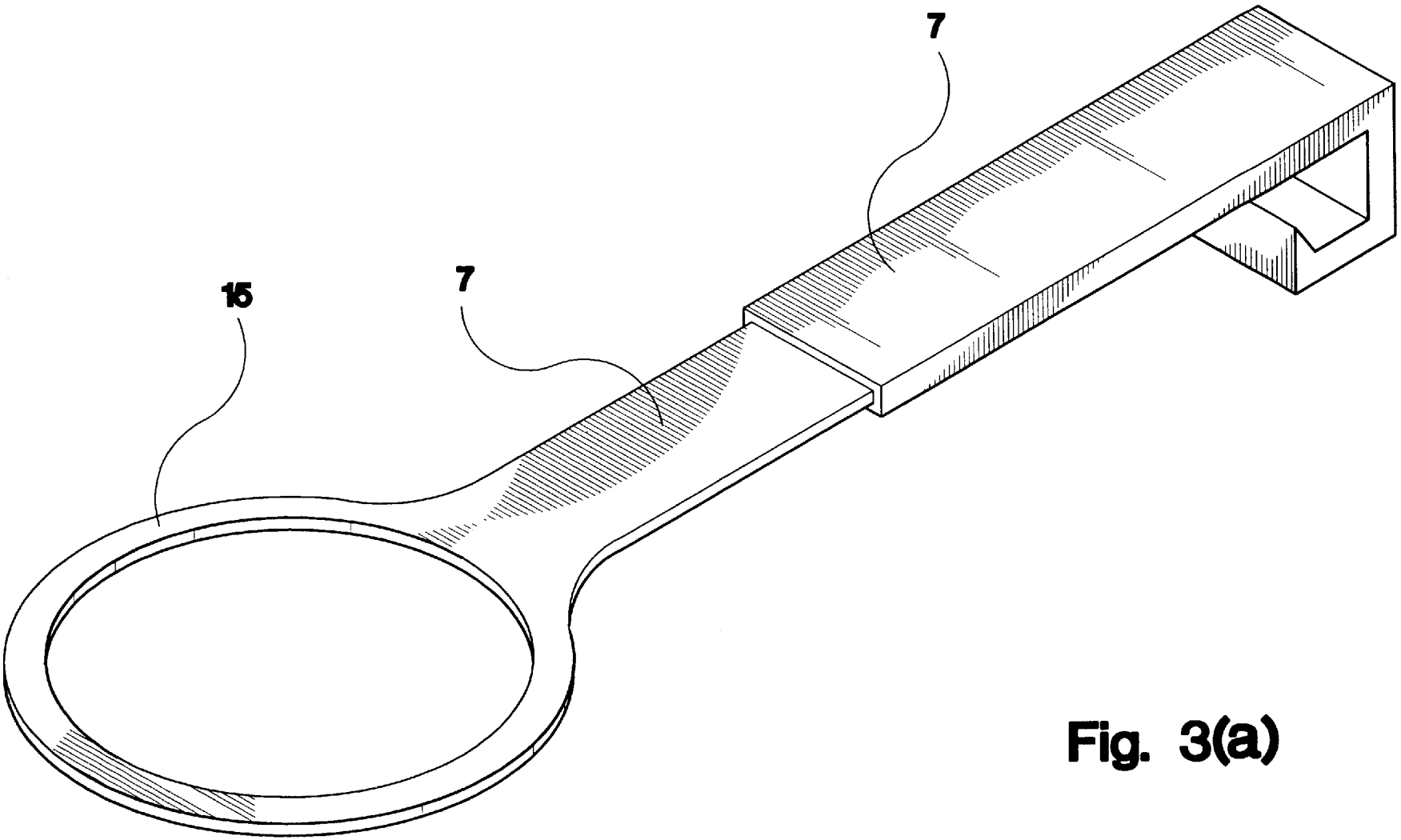
FIG. 3 shows a side view of the FIG. 1 cup holder mounted to the seat portion of the stadium seat shown in cross section.

FIG. 1 is a perspective view of the invention's preferred embodiment 1 mounted on an existing horizontally stadium seat 3. An end held beverage cup 5 with a tapered lower end portion capable of containing a liquid beverage such as soda, beer, etc. is seated in an end hole formed in the straight cup holder and held therein by the shape of the cup relative to the hole size and the downward force of gravity acting on the cup and its contents. Extending from and fixed to the cup holder's holed end is a rigid elongated seat engaging elongated member 7 whose length is substantially the same as the width W of the horizontal seat member 3. Member 7 and its loop cup holding end reside generally in the same plane. The end of the elongated member 7 opposite the hole end has a depending lower end clip member 9 partially shown in this figure. Also, depicted in the same first figure is the indicia 11 molded in or printed on the upper exposed surface of the elongated member 7. This indicia may be used to advertise products or indicate the name of the user or any other desired words or symbols.

FIG. 2 is a reversed perspective view of the FIG. 1 cup holder 1 apparatus by itself. The round circular hole 13 formed by the closed loop structure 15 in which the cup 5 is mounted and held is better shown in this view. In addition, the end clip 9 located on and attached to the opposite end of extension member 7 from the loop end is shown as being a flexible U-shaped bracket whose two leg ends are spaced apart a distance directly related to the vertical thickness of the horizontal seat's end member on which mounted.

FIG. 3 shows a side view of the FIG. 1 cup holder 1 mounted to the seat portion of the stadium seat shown in cross section. The U-shaped clip end 9 of the cup holder portion is shaped and sized such that its two spaced leg segments 17 and 19 provide an opening there between which receives the horizontal seat's end U-shaped bracket segment 23. A small upwardly facing end portion 21 integral with the spaced free leg end 19 fits over the complementarily shaped upwardly facing end 25 typically found on the underside of the rear (opposite the direction the patrons are viewing the game) end of an existing stadium seat. Should the existing horizontally disposed seating portion have a different lower end portion, the holding depending clip end 9 would be changed to complement this shape and size by providing of a clip which fits over the existing seat end and wraps around a portion thereof to hold the cup holder 1 thereto. The spacing between the cup holder clip's two legs 17 and 19 may be adjustable to a limited degree by making material for the clip 9 of a flexible expandable material. Different sized and shaped cup holders could be designed and made to accommodate different sized and shaped horizontal seating portions of existing seats. Alternatively, the distance spanned by the elongated member 7 could also be adjustable within a given range by providing for two separate elongated slidable members which overlap as shown in FIG. 3(*a*) or telescope into each other horizontally or by using an expandable material for the elongated member 7 such a rubber. In any event, the cup holder has an end fastener clip which mounts to the existing seat structure end to hold and retain the loop cup holder holed end 15 firmly in place relative to the particular seating arrangement. In one specific embodiment of the FIG. 1 embodiment, the elongated member 7 was 15.695 inches long by 1.50 inches wide and the formed cup receiving end hole 13 was 3.60 inches in diameter.

FIG. 4 shows a cross sectional end portion of an alternate mounting extension member end clip 27 specifically designed for a flat wooden type bench seat. In this partially shown cup holder the end clip end opposite the formed cup holder hole 13 is also U-shaped when viewed from the side. However, in this end clip the lower leg portion 19' has no upwardly facing member 21 attached to it since such is not need to complement the shape of the wooden bench seat normally consisting of a flattened rectangular board B whose clip engaging rear end (shown by dotted lines) fits into the formed spacing between the clip's legs.

Figure 5:
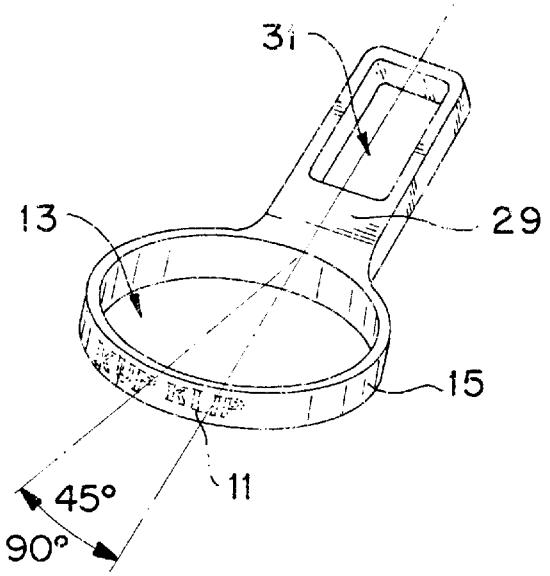
FIG. 5 depicts an alternate embodiment of the cup holder adapted to be mounted on one end of the arm rim edges of an existing seat.

FIG. 5 depicts an alternate embodiment of the cup holder adapted to be mounted on one of the arms' side rims of an existing seat. In this second embodiment the elongate straight cup holder member 7 is replaced by a smaller length second rigid straight closed loop member 29 formed integrally with and angled from the first closed loop cup holding end 15. The looped end 15 is angled upwardly from the straight extension member 7 by the shown angle a (where a is about 45 degrees up to no more than about 90 degrees) to accommodate this different method of mounting the second cup holding end to a different part of the seat. The second closed loop end hole 31 formed by the end of member 29 is shaped to complement the size and shape of the small side seat upright side rim edge member commonly found on many stadium seats. The indicia 11 formerly on the exposed upper surface of member 7 is now found on the front exposed surface of the loop member 15.

Figure 6:
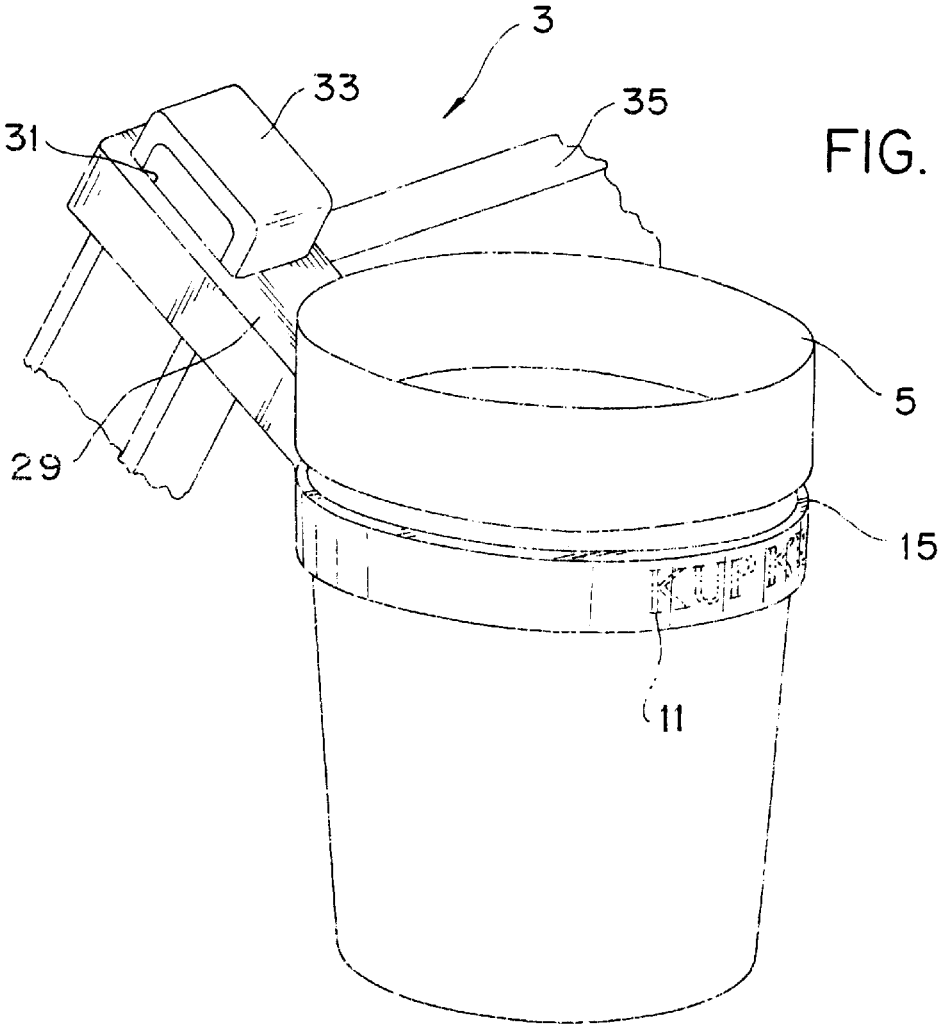
FIG. 6 illustrates the FIG. 5 embodiment mounted on a side rim support of an existing stadium seat.

FIG. 6 illustrates the FIG. 5 embodiment mounted on a small side seat upright side rim edge 33, not the seat's arm rest, of an existing stadium seat. Normally the upright side edge 33 is vertically disposed and perpendicular to the flat horizontally disposed seat portion 35 of seat 3 on which the patron's buttocks or derriere engages when seated. The front end portion of edge member 33 normally protrudes slightly forward of the end of portion 35 to provide a lip on which the closed loop 31 may fit around to hold the cup holder to the side of the seat. In one embodiment the rectangular formed hole 31 was 1.6 inches long by 0.950 inches wide while the formed loop around the hole was 1.250 wide. The larger round hole 13 used to mount the cup 5 was angled (angle a) upwardly about 45 degrees up to no more than about 90 degrees as measured from the straight vertically disposed member 29 to the joined first loop end 15 to insure any fluids in the cup 5 would be upright and not spill when mounted to the rim side 33.

Both the looped cup receiving ends and the extension members as well as the opposite end fastening end members, whether a clip or closed second loop, may be formed as a integral unit using the plastic injection molding process. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed (in this case the cup holder or either the first or second embodiment). High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price. The process should be invaluable in producing this invention's cup holder cost effectively.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What we claim as our invention is:

1. The combination of a holder for a container and a seat engaged by the holder comprising:

a generally closed looped end adapted to engage the side surfaces of a liquid containing container to be held therein;

a straight rigid member extending from and attached to said closed looped end, said rigid member engaging a portion of the seat on which the liquid containing container is to be mounted:

an end fastening member attached to said rigid member on the end opposite said closed looped end for engaging an edge portion of the seat member to be engaged, said end fastening member having a U-shaped end bracket; and a seat engaged by said end fastening member, said seat having a U-shaped end clip sized and shaped to complement the shape and size of the U-shaped end fastening member to permit the holding of the container holder to the seat.

2. The combination as claimed in claim 1 wherein said rigid member consists of two separate members slidably joined together such that one member overlaps the other member.

* * * * *